US008833473B2

(12) United States Patent
McRobb et al.

(10) Patent No.: US 8,833,473 B2
(45) Date of Patent: Sep. 16, 2014

(54) SEALING ASSEMBLY

(75) Inventors: Graeme McRobb, Aberdeenshire (GB); John Dewar, Edinburgh (GB)

(73) Assignee: Swellfix B.V., Rijswijk (NL)

( * ) Notice: Subject to any disclaimer, the term of this patent is extended or adjusted under 35 U.S.C. 154(b) by 891 days.

(21) Appl. No.: 12/675,359

(22) PCT Filed: Aug. 22, 2008

(86) PCT No.: PCT/GB2008/002882

§ 371 (c)(1),
(2), (4) Date: Jun. 18, 2010

(87) PCT Pub. No.: WO2009/027658

PCT Pub. Date: Mar. 5, 2009

(65) Prior Publication Data

US 2010/0307771 A1 Dec. 9, 2010

(30) Foreign Application Priority Data

Aug. 25, 2007 (GB) ..... 0716640.8

(51) Int. Cl.
*E21B 33/12* (2006.01)
*E21B 33/127* (2006.01)

(52) U.S. Cl.
CPC ..... *E21B 33/1208* (2013.01); *E21B 33/1277* (2013.01); *Y10S 277/934* (2013.01)
USPC ..... 166/387; 166/191; 277/934

(58) Field of Classification Search
CPC ..... E21B 33/1208; E21B 33/1293; C09K 2003/104; C09K 2003/1043; F16L 17/035; F16L 15/064; F16L 15/104; F16L 15/122; F16L 15/121
USPC ..... 166/118, 179, 292, 387, 191; 277/934, 277/607, 626–627, 630, 637, 650–654
See application file for complete search history.

(56) References Cited

U.S. PATENT DOCUMENTS

| | | | |
|---|---|---|---|
| 2,849,070 | A | 8/1958 | Maly |
| 3,385,367 | A | 5/1968 | Kollsman |
| 4,919,989 | A | 4/1990 | Colangelo |
| 7,296,597 | B1 | 11/2007 | Freyer et al. |

(Continued)

FOREIGN PATENT DOCUMENTS

| | | | |
|---|---|---|---|
| EP | 2133509 | A1 | 12/2009 |
| GB | 2396635 | A | 6/2004 |

(Continued)

OTHER PUBLICATIONS

Intellectual Property Office Search re GB 1005323.9, dated Jul. 29, 2010.

(Continued)

*Primary Examiner* — Kenneth L Thompson
*Assistant Examiner* — Wei Wang
(74) *Attorney, Agent, or Firm* — Thomas A. Runk; Fulwider Patton LLP

(57) ABSTRACT

A downhole sealing assembly (10) comprises a sleeve (12) adapted to be mounted on a body, the sleeve (12) including a swellable material and defining a sealing arrangement comprising inner and outer seals (18, 20). Swelling of the material radially extends the seals (18, 20).

34 Claims, 3 Drawing Sheets

(56) References Cited

U.S. PATENT DOCUMENTS

| | | | | |
|---|---|---|---|---|
| 7,431,098 | B2 * | 10/2008 | Ohmer et al. | 166/387 |
| 2003/0075323 | A1 * | 4/2003 | Vercaemer et al. | 166/277 |
| 2004/0144538 | A1 | 7/2004 | Richard | |
| 2005/0199401 | A1 * | 9/2005 | Patel et al. | 166/387 |
| 2007/0151724 | A1 | 7/2007 | Ohmer | |
| 2008/0190600 | A1 | 8/2008 | Shkurti et al. | |
| 2008/0308266 | A1 | 12/2008 | Roberts et al. | |

FOREIGN PATENT DOCUMENTS

| | | | |
|---|---|---|---|
| GB | 29411918 | | 9/2005 |
| WO | 9945233 | | 9/1999 |
| WO | 0220941 | | 3/2002 |
| WO | 03008756 | | 1/2003 |
| WO | WO2004057715 | | 7/2004 |
| WO | 2008033115 | A1 | 3/2008 |
| WO | 2008060297 | A2 | 5/2008 |
| WO | 2008062186 | A1 | 5/2008 |
| WO | 2008060297 | A3 | 8/2008 |
| WO | 2008097312 | A1 | 8/2008 |
| WO | 2009098467 | A1 | 8/2009 |

OTHER PUBLICATIONS

Intellectual Property Office Search re. GB1005995.4, dated May 13, 2010.

Extended European Search Report for PCT Application No. PCT/GB2008/002887, Sep. 3, 2010, 2 pgs.

* cited by examiner

SEALING ASSEMBLY

RELATED APPLICATIONS

This application is a U.S. National Phase of International Patent Application No. PCT/GB2008/002882, filed Aug. 22, 2008, which claims priority from Great Britain Application Serial No. 0716640.8, filed Aug. 25, 2007, the entire contents of both of which are incorporated herein by reference.

FIELD OF THE INVENTION

The present invention relates to a sealing assembly, and in particular to a downhole sealing assembly incorporating a swellable medium.

BACKGROUND TO THE INVENTION

In the oil and gas exploration and production industry there are many occasions where seals of varying configurations must be established downhole. For example, seals may be required within an annulus defined between, for example, concentric tubulars, between a tubular and a bore wall, or the like. Such seals may be achieved by use of mechanical actuators which physically set, and in some occasions release sealing members at the desired location. However, there are inherent reliability concerns associated with any downhole mechanical assembly in view of the significant difficulties and costs associated with recovering a failed assembly and implementing appropriate remedial measures.

It has been proposed in the art to establish seals in downhole annular locations using materials which swell upon contact with a particular activator, such as water, hydrocarbons or the like. Generally, the swellable material, such as a swelling elastomer, is positioned in an annular space, for example between a tubing string and a bore wall, and then subsequently permitted to swell, for example upon contact with ambient fluids, to fill the annular space and establish the necessary seal. The swellable material is normally mounted and bonded to the exterior surface of conventional wellbore tubulars, such as casing tubulars, liner tubulars, production tubulars and the like. However, this arrangement requires the conventional tubulars to be modified, or specially manufactured, which may increase operation costs and cause delays to wellbore operations.

It has also been proposed in the art to provide a swelling material on a separate sleeve which may subsequently be mounted on the required wellbore tubular. However, an appropriate seal between the sleeve and the tubular must be established to prevent migration of fluids past the sleeve. Conventional sealing arrangements may include o-ring seals and the like which may not provide the necessary sealing integrity, especially when exposed to extremely large pressure differentials. Additionally, conventional seals, such as o-rings, may be damaged or displaced when the sleeve is mounted on the tubular.

SUMMARY OF THE INVENTION

According to a first aspect of the present invention, there is provided a downhole sealing assembly comprising a sleeve adapted to be mounted on a body, the sleeve including a swellable material and defining a sealing arrangement comprising inner and outer seals, whereby swelling of the material radially extends the seals.

Advantageously, in use, the sleeve may be mounted on a body and subsequently run downhole into a bore, and the swellable material of the outer and inner seals activated to swell to establish a seal between the sleeve and a wall of the bore, and between the sleeve and the body. The bore wall may comprise an inner surface of a downhole tubular. Alternatively, or additionally, the bore wall may comprise an inner wall surface of an open drilled bore. Accordingly, the downhole sealing assembly may establish an effective annulus seal such that fluid migration along an annulus defined between the bore wall and outer surface of the body will not be permitted past the sealing assembly. Furthermore, the downhole sealing assembly may be adapted to prevent migration of fluids from the surrounding earth into the wellbore, or alternatively, or additionally the loss of fluids from the wellbore into the surrounding earth.

The sleeve may comprise a structural or frame element on which the swellable material is mounted. The structural element may take the form of a generally cylindrical sleeve which may define a substantially continuous wall. Other embodiments may feature an open framework or support member, for example a mesh or spring-like member.

The structural element may be of any suitable material, and will typically be formed of metal.

The sealing assembly may be adapted to function as a packer, and may be adapted to isolate sections of a downhole formation from a wellbore.

The present invention may permit a sealing assembly incorporating a swellable seal to be provided on a body, without requiring the body to be modified.

The sleeve may be adapted to be mounted on a tubular body, such as a casing tubular, liner tubular, drilling tubular, production tubular or the like. The sleeve may also, or alternatively, be adapted to be mounted on a solid body.

The sleeve may be adapted to be slidably mounted on the body. The sleeve may be provided with fixings which allow the sleeve to be fixed to the body, for example grub screws or the like which extend through the sleeve to engage an outer face of the body. In other embodiments the sealing assembly may be positioned between stops provided on the body, which stops may allow a degree of movement of the assembly along the body or may fix the assembly relative to the body. The casing collars or the like may provide the stops, or stops may be provided for locating the assembly more precisely on a section of tubing. The sleeve may be mounted simply by sliding the sleeve over one end of the base pipe. Alternatively, the sleeve may be adapted to be threadably mounted on the body. In one embodiment the sleeve may define a connector adapted to connect at least two bodies together. The sleeve may define a threaded connector or the like.

The swellable material may be adapted to swell by volumetric expansion thereof. Alternatively, or additionally, the swellable material may be adapted to swell by inflation thereof. In embodiments of the invention the swellable material may be adapted to swell upon exposure to an activator. The swellable material may be adapted to be activated by a chemical activator, thermodynamic activator, fluid dynamic activator, or the like, or any suitable combination thereof. For example, the swellable medium may be adapted to be activated by a fluid, such as water, hydrocarbons, cement, drilling mud, or the like, or any suitable combination thereof. Alternatively, or additionally, the swellable material may be adapted to be activated by heat, pressure or the like.

The outer and inner seals may comprise a similar or identical swellable material. Alternatively, the outer and inner seals may comprise dissimilar swellable materials, for example materials which swell in the presence of different materials. The swellable material forming the seals may be graded such that different regions of the swellable material are formed from different materials, or from similar materials having different properties.

The outer seal may be mounted on the outer surface of the sleeve. The outer seal may be mounted directly on the outer surface of the sleeve, or may be indirectly mounted, for example via a mounting collar or the like. The outer surface of the sleeve structural element may define a recess adapted to receive and accommodate at least a portion of the outer seal. Providing such a recess facilitates provision of a greater depth of swellable material, and thus provide for a greater expansion potential. The outer diameter of the outer seal will tend to be limited by, for example, restrictions the seal must pass through while being run into the bore, and the provision of a recess or profile facilitates provision of extra depth of material to provide for a greater degree of expansion. The provision of such a recess, or some other profile, may also serve to assist in anchoring the swellable material to the supporting sleeve. The outer seal may completely or at least partially circumferentially extend around the outer surface of the sleeve. The outer seal may extend along the entire axial length of the sleeve, or alternatively may extend along a partial axial length of the sleeve.

At least a portion of the outer seal may be mounted on the inner surface of the sleeve and adapted to extend towards the outer surface when the sealing material is activated to swell.

The inner seal may be mounted on the inner surface of the sleeve, and may be mounted directly or indirectly on the inner surface of the sleeve. The inner surface of the sleeve may define a recess adapted to receive and accommodate at least a portion of the inner seal. The inner seal may completely or at least partially circumferentially extend around the inner surface of the sleeve. The inner seal may extend along the entire axial length of the sleeve, or alternatively may extend along a partial axial length of the sleeve.

The inner seal may comprise a smaller depth of swellable material than the outer seal, reflecting the lesser degree of expansion required for the inner seal to form a seal with the base pipe (perhaps 30-60 thousands of an inch radial extension) than for the outer seal to form a seal with a surrounding bore wall.

At least a portion of the inner seal may be mounted on the outer surface of the sleeve and adapted to extend towards the inner surface when the sealing material is activated to swell.

In one embodiment the outer and inner seals may be separately formed. In this embodiment the sealing arrangement may be discontinuous. The separately formed seals may be mounted on the sleeve in non-contact relationship relative to each other. Alternatively, the separately formed seals may be mounted on the sleeve in contact with each other. The separately formed seals may be coupled together, for example via adhesive bonding, interlocking fitting or the like.

Alternatively, the outer and inner seals may be integrally formed with each other. In this embodiment the sealing arrangement may be continuous. The sealing arrangement may be moulded onto the sleeve to integrally provide the outer and inner seals.

The sealing arrangement may extend through the sleeve. For example, the sleeve may comprise at least one slot extending through the sleeve from the outer surface to the inner surface thereof, wherein the sealing assembly extends through said slot. In one arrangement a plurality of slots may be provided and may be circumferentially distributed around the sleeve.

Alternatively, or additionally, the sealing arrangement may extend over an axial end face of the sleeve to extend between the inner and outer surfaces thereof. In this arrangement the outer and inner seals may be joined by an intermediate portion located adjacent the axial end face of the sleeve. The intermediate portion may comprise a swellable material, or alternatively may comprise a non-swellable material.

The sealing arrangement may extend over opposed axial end faces of the sleeve to extend between the inner and outer surfaces thereof.

The sealing assembly may comprise a plurality of sealing arrangements, which sealing arrangements may be similar to each other, or alternatively may differ from each other. A sealing arrangement may be mounted on axially opposed end regions of the sleeve. The swellable material within each sealing arrangement may be similar or dissimilar. In one embodiment the swellable material within one sealing arrangement may be adapted to be activated when exposed to water, and the swellable material within the other sealing arrangement may be adapted to be activated when exposed to hydrocarbons, such as oil.

A sealing arrangement may be mounted on the sleeve intermediate the end regions thereof. The intermediate sealing arrangement may comprise at least one of an outer seal and an inner seal, and may comprise a swellable material.

The sealing assembly may comprise a centraliser or protector mounted on the sleeve. The centraliser may be adapted to centralise the sleeve and the body upon which the sleeve is mounted within a bore. The centraliser may also be adapted to protect the sealing arrangement when the sealing assembly is initially run into a bore. The centraliser may be mounted on the sleeve between two sealing assemblies. The centraliser may be secured to the sleeve, for example via a screwing arrangement, interference fit, clamping arrangement or the like.

The centraliser may be formed of a robust, low friction material, such as a metal or polymeric material, such as polyurethane. The centraliser may be colour-coded to reflect a feature of the assembly, for example the triggering fluid for the swellable material(s). For example, one colour may indicate an assembly which swells in the presence of water, a second colour indicating an assembly which swells in the presence of oil, and a third colour indicating an assembly which includes swelling material which will swell in the presence of oil or water.

According to a second aspect of the present invention, there is provided a downhole sealing assembly comprising;

a body;

a sleeve mounted on the outer surface of the body, and comprising a sealing arrangement including a swellable material and defining inner and outer seals, whereby swelling of the material activates the seals.

The sealing assembly may comprise a plurality of sleeves mounted axially along the body.

According to a third aspect of the present invention, there is provided a downhole sealing assembly comprising:

a sleeve adapted to be mounted on a body;

an outer seal on an outer surface of the sleeve; and an inner seal on an inner surface of the sleeve, wherein the outer and inner seals are joined together and comprise a swellable material.

The outer and inner seals may be integrally formed, and may be formed in a moulding operation. Alternatively, the outer and inner seals may be separately formed and subsequently joined or secured together.

According to a fourth aspect of the present invention, there is provided a method of providing a downhole seal, said method comprising the steps of:

mounting a sleeve on a body, wherein the sleeve comprises a sealing arrangement having an outer seal and an inner seal wherein the inner and outer seals comprise a swellable material;

running the body downhole into a bore;

activating the outer seal to swell to form a seal between the sleeve and a wall of the bore; and activating the inner seal to swell to form a seal between the sleeve and the body.

The various features defined above in relation to the first aspect may be utilised in conjunction with or as part of the invention defined in the second, third and fourth aspects.

The thickness of swellable material provided in the various aspects of the invention described above will depend on a number of factors. Where a swelling elastomer is utilised, the maximum volume to which the elastomer will swell in the presence of the activating medium may be determined. At maximum volume, the elastomer will likely have a reduced ability to resist deformation, and accordingly the elastomer thickness will normally be selected to provide a degree of "unused" swell, which also provides a margin of error if the diameter of the opposing surface is not as expected, for example if a bore wall has been washed out. The swelling elastomer thickness may be selected to swell to 90%, 80%, 70%, 60%, 50%, 40% or less of the maximum swell capacity. In an application where the seal is intended to resist fluid pressure, an unused swell capacity of approximately 50% or more is considered appropriate, the tendency of the elastomer to swell further providing a degree of pre-loading of the seal, and in certain circumstances permitting the swellable material to be utilised as an anchor or hanger and support a significant axial load. On the other hand, providing only a very limited ability to swell may place high loads on the elastomer and adjacent structure, and should be avoided if possible. Thus, where inner and outer seals are provided on opposite sides of a structural member the relative thicknesses of the seal-forming material should be selected such that the unused swell of each seal provides a comparable pressure.

Clearly this aspect of the invention, that is the selection of appropriate swelling elastomer thickness, will have utility in any seal arrangement utilising swelling elastomers.

According to a further aspect of the invention there is provided a method of producing a swelling elastomer seal having a seal surface adapted to provide a contact with an opposing surface, the method comprising:

determining the dimensions of the opposing surface;

determining the dimensions of the seal surface;

determining the difference between said dimensions; and determining the thickness of swelling elastomer required to provide the volumetric expansion necessary to bridge said difference while providing a predetermined degree of unused swell.

The method steps need not necessarily be carried out exactly in this order, and the design of a seal may be an iterative process or confirmatory process.

The degree of unused swell will be selected depending on the application of the seal, for example a seal which must withstand higher pressures having a higher proportion of unused swell than a seal which is used simply to divert flow.

The swelling elastomer may provide the seal surface, or the seal surface may extend over the elastomer or be otherwise operatively associated with the surface.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
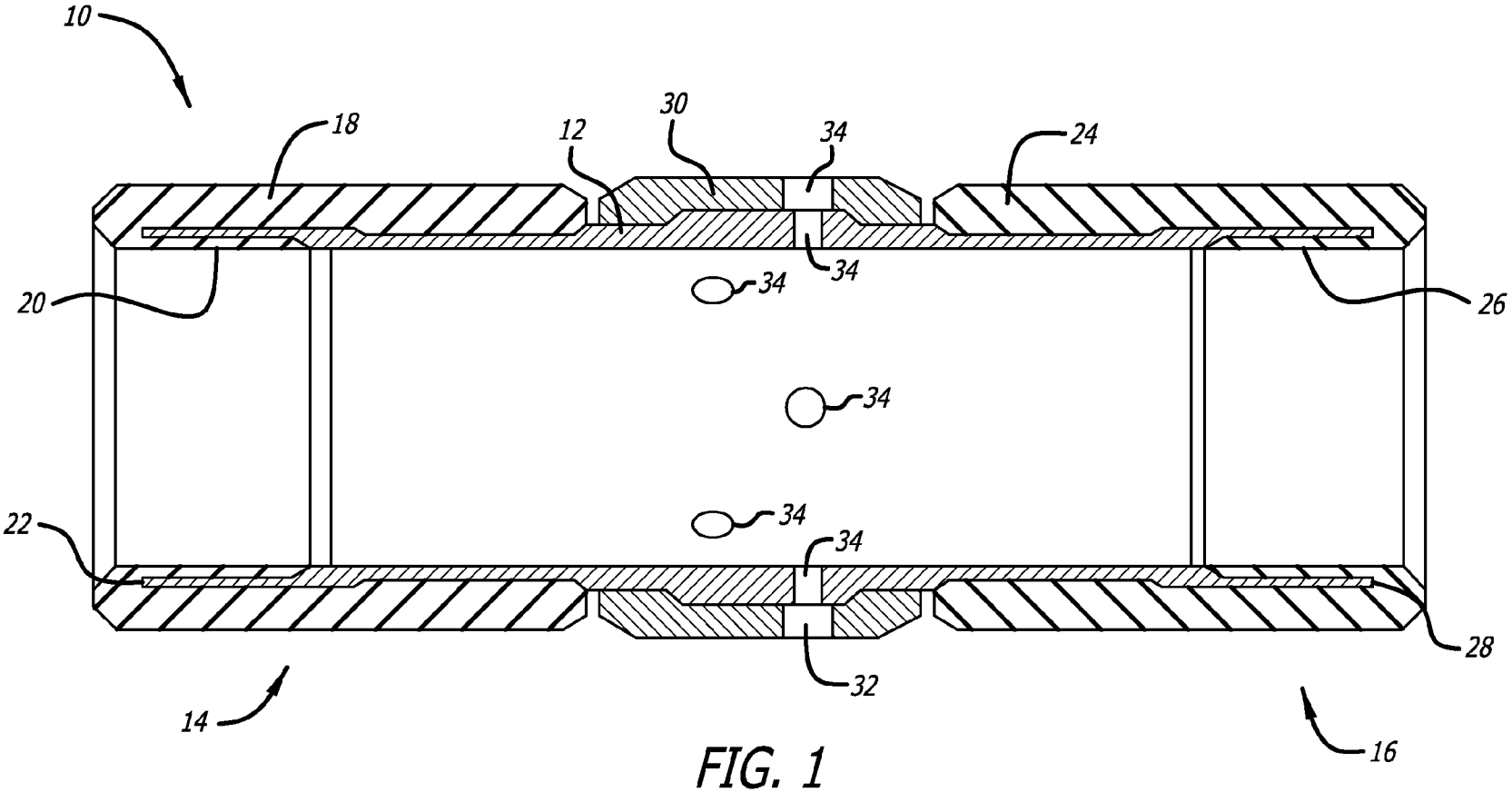
FIG. 1 is a longitudinal cross sectional view of a sealing assembly according to an embodiment of the present invention.

Reference is first made to FIG. 1 of the drawings in which there is shown a longitudinal cross-sectional view of a sealing assembly, generally identified by reference numeral 10, in accordance with an embodiment of the present invention. The sealing assembly 10 comprises a sleeve 12 which, as will be described in further detail below, is adapted to be mounted on a body, such as a tubular body. A first sealing arrangement 14 is mounted on one axial end of the sleeve 12, and a second sealing arrangement 16 is mounted on an opposite axial end of the sleeve 12.

The first sealing arrangement 14 comprises an outer seal 18 which circumferentially extends around the outer surface of the sleeve 12, and an inner seal 20 which circumferentially extends around the inner surface of the sleeve 12, wherein the outer and inner seals 18,20 are integrally formed such that the sealing arrangement 14 extends over an axial end face 22 of the sleeve 12. Similarly, the second sealing arrangement 16 also comprises an outer seal 24 mounted on the outer surface of the sleeve 12 and an integrally formed inner seal 26 mounted on an inner surface of the sleeve 12 such that the second sealing arrangement 16 extends over an opposite axial end face 28 of the sleeve 12.

The outer and inner seals 18,24,20,26 of the first and second sealing arrangements 14,16 are formed of a swellable material, such as a swellable elastomer. The swellable material is adapted to swell when exposed to a particular activator. In the embodiment shown the swellable material forming both the first and second sealing arrangements 14,16 is adapted to be activated to swell when exposed to water. However, it should be understood that any swelling material or combination of materials may be utilised in accordance with user requirements.

In use, the sealing assembly 10 is mounted on the outer surface of a body (not shown), such as a production tubing string, and is subsequently run downhole into a wellbore. When the swellable material of the first and second sealing arrangements 14,16 is exposed to a particular activator, which as noted above in this embodiment is water, the material will be activated to swell causing the outer seals 18,24 to expand radially outwardly and the inner seals 20,26 to expand radially inwardly. Accordingly, the expanded outer seals 18,24 may form a seal against the wall surface of the wellbore, and the expanded inner seals 20,26 may establish a seal against the outer surface of the body upon which the sealing assembly 10 is mounted.

It will be noted from FIG. 1 that the elastomer forming the outer seals 18, 24 is significantly thicker than the elastomer forming the inner seals 20, 26, and also has a greater axial extent. This reflects the greater demands placed on the outer seals 18, 24, which much extend further to achieve contact with the opposing sealing surface, and which may also be seeking to achieve a sealing contact with an unlined bore wall. In contrast, the inner seals 20, 26 will typically only need to bridge a small gap, perhaps 30-60 thousands of an inch, to contact the surface of the body on which the assembly is mounted. It will also be noted that the outer diameter of the structural metal sleeve 12 has a reduced outer diameter spaced from the sleeve ends, which permits a greater depth of elastomer to be moulded onto the sleeve 12 while still maintaining a constant outer seal diameter. This provides for greater swelling capacity of the outer seals.

The sealing assembly 10 may therefore establish an effective annulus seal such that fluid migration along an annulus defined between the wall of the bore and the outer surface of the body will not be permitted past the sealing assembly 10. Additionally, the downhole sealing assembly 10 may therefore also be used to prevent migration of fluids from the surrounding earth into the wellbore, or alternatively, or additionally the loss of fluids from the wellbore into the surrounding earth. Of course the assembly 10 will also be effective to prevent sand migration.

The sealing assembly 10 further comprises a centraliser collar 30 mounted on the outer surface of the sleeve 12 and interposed between the first and second sealing arrangements 14,16. The centraliser collar 30 is secured to the sleeve 12 via studs 32 which threadably engage respective bores 34 extending through the wall of the sleeve 12.

The centraliser collar 30 describes a slightly larger diameter than that of the first and second sealing arrangements when in an unexpanded state. Accordingly, the centraliser collar 30 will function to centralise the sealing assembly 10 and the body upon which the sealing assembly 10 is mounted within a wellbore, and will also protect the outer seals 18, 24 from wear and damage.

It will be understood by those of skill in the art that the sealing assembly 10 of the present invention may be utilised in a number of downhole applications where an annulus seal is required. However, an example of one use of the sealing assembly 10 is described below with reference to FIGS. 2 and 3.

Figure 2:
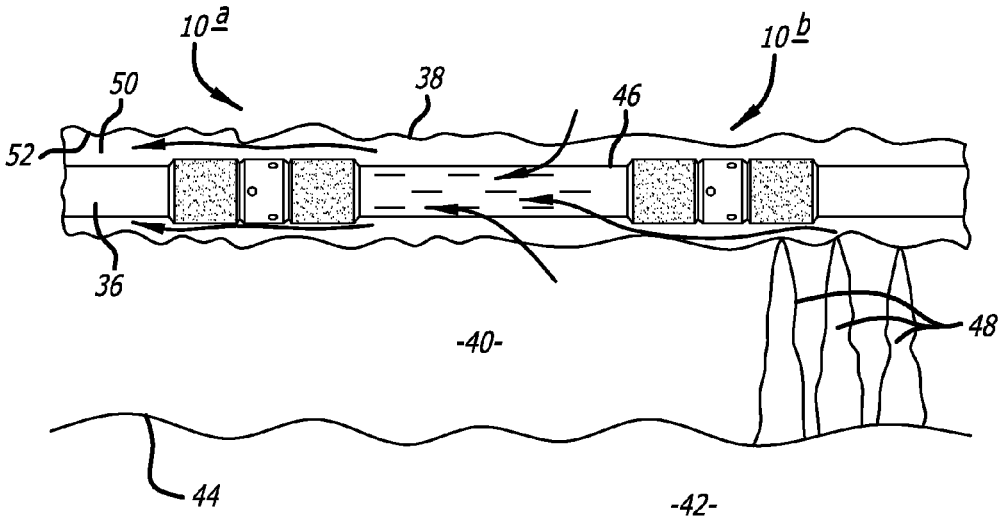
FIG. 2 is a diagrammatic representation of two of the sealing assemblies of FIG. 1, shown mounted on a tubing string and positioned within a wellbore.
Figure 3:
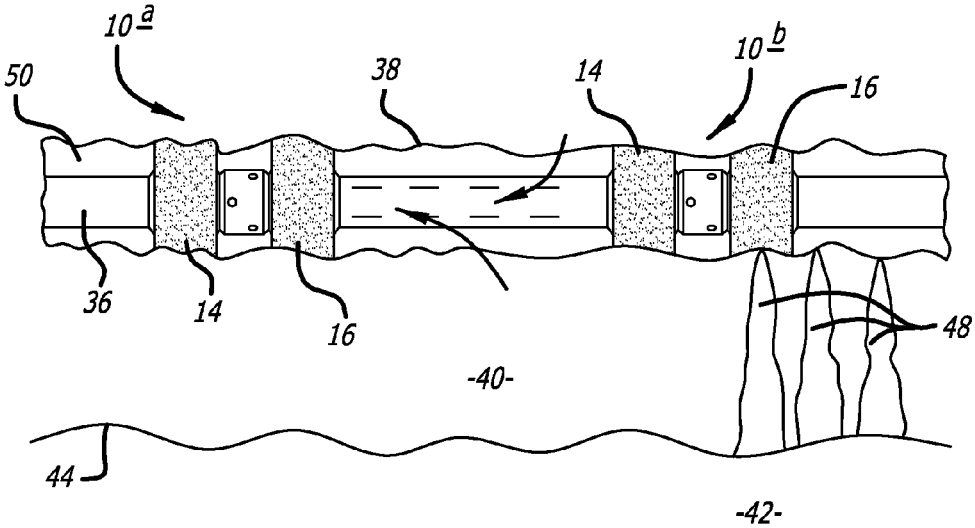
FIG. 3 is a further diagrammatic representation of the sealing assemblies and tubing string shown in FIG. 2, wherein the sealing assemblies are shown in a sealing configuration.

Referring initially to FIG. 2, there is diagrammatically shown a portion of a production tubing string 36 which has been run into a horizontal wellbore section 38 and which comprises two of the sealing assemblies shown in FIG. 1. The sealing assemblies are generally identified by reference numerals 10*a* and 10*b*. The wellbore 38 extends through an oil bearing formation 40 which is positioned above a water bearing formation 42 and separated therefrom via an oil water interface 44.

Accordingly oil from formation 40 may migrate into the wellbore 38 and subsequently into the production tubing string 36 through slotted production tubulars 46, for example. However, the wellbore 38 may extend through formation fractures 48 which permit migration of water from formation 42 into the wellbore 38. If left unattended, water will therefore also enter the production string 36 and be produced to surface with the oil, which is undesirable. Furthermore, both oil and water may migrate along the annulus 50 formed between the production string 36 and the inner wall surface 52 of the wellbore 38 which is also undesirable. Such undesirable migration of fluids into and through the wellbore 38 may be prevented by the sealing assemblies 10 of the present invention when these are activated to establish appropriate seals within the wellbore 38, which will now be discussed in detail with reference to FIG. 3.

The first and second sealing arrangements 14,16 of each sealing assembly 10 have been activated to swell and expand upon contact with fluids within the wellbore 38. It should be noted that the swellable material may differ between each sealing assembly 10*a*, 10*b*, and also between each sealing assembly 12,14 of each sealing assembly 10*a*, 10*b*. The expanded sealing arrangements 14, 16 therefore establish seals within the annulus 50, and also between each sealing assembly 10 and the outer surface of the tubing string 36. Accordingly, migration of fluids along the annulus past the sealing assemblies 10 will be prevented. Furthermore, as sealing assembly 10*b* is positioned adjacent the formation fractures 48, these fractures may be closed to the wellbore 38. Accordingly, the sealing assembly 10*b* therefore prevents migration of water from formation 42 into the wellbore 38. As such, the volume of water produced to surface with the oil may be significantly minimised.

It will be appreciated that additional sealing assemblies may be mounted along the length of the production string 36 in accordance with user requirements. Additionally, further sealing assemblies of the present invention may be mounted on the production tubing 36 in order to span the full extent of the formation fractures 48 to therefore completely seal the wellbore 38 at this location within the wellbore 38.

Figure 4:
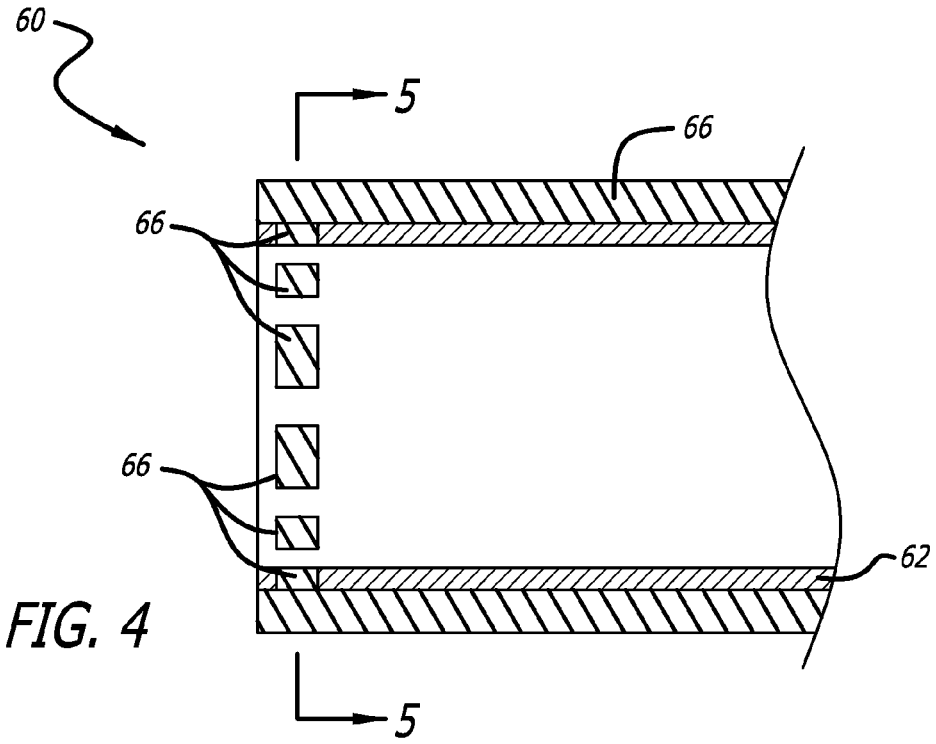
FIG. 4 is a longitudinal cross-sectional view of a portion of a sealing assembly according to an alternative embodiment of the present invention.

Reference is now made to FIG. 4 of the drawings in which there is shown a longitudinal cross-sectional view of an end portion of a sealing assembly, generally identified by a reference numeral 60, in accordance with an alternative embodiment of the present invention. The sealing assembly 60 comprises a sleeve 62 which in use is adapted to be mounted on the outer surface of a body (not shown). A plurality of slots 64 extend through the wall of the sleeve 62 from an outer to an inner surface thereof, wherein the slots 64 are circumferentially distributed about an end region of the sleeve 62. A swellable sealing material 66 is circumferentially mounted around the outer surface of the sleeve 62 and extends into the slots 64. It should be noted that the opposite axial end of the sealing assembly 60 corresponds to the axial end shown in FIG. 4. Accordingly a sealing arrangement may be formed on either end region of the sleeve 62.

Figure 5:
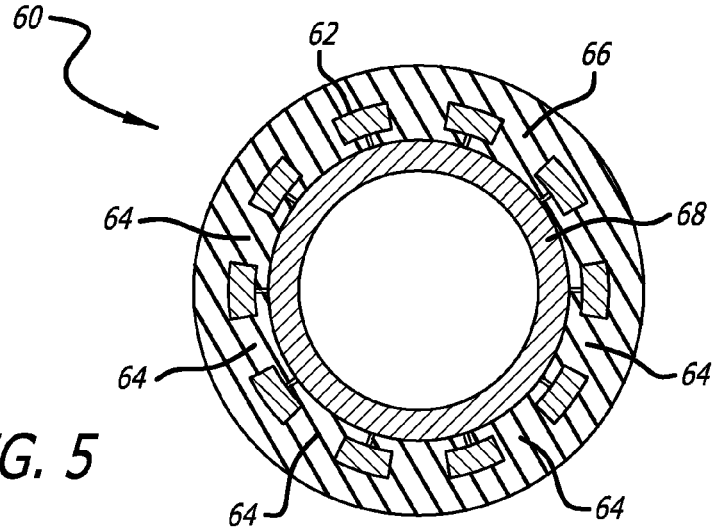
FIG. 5 is a lateral cross-sectional view of the sealing assembly of FIG. 4, taken along line 5-5 of FIG. 4, wherein the sealing assembly is shown mounted on a tubular body.

Reference is now made to FIG. 5 of the drawings in which there is shown a lateral cross-sectional view of the sealing assembly 60 shown in FIG. 4, taken through line 5-5, wherein the sealing assembly 60 is shown in FIG. 5 mounted on a tubular body 68. In use the tubular body 68 and sealing assembly 60 may be run into a wellbore, such as wellbore 38 shown in FIGS. 2 and 3. When the swellable material 66 is exposed to its particular activator, such as water, the material 66 will be caused to swell to expand radially outwardly and thus form a seal with the wall of the wellbore. Additionally, the material 66 will be caused to swell radially inwardly and through the slots 64 to therefore engage the outer surface of the tubular body 68. Swelling of the material 66 may occur until the entire annular space formed between the tubular body 68 and the sleeve 62 is filled, such that a seal may be established.

It should be understood that the embodiments described above are merely exemplary and that various modifications may be made thereto without departing from the scope of the invention.

For example, in the sealing assembly 10 first shown in FIG. 1, the outer and inner seals of each sealing arrangement are integrally formed. However, in alternative arrangements the outer and inner seals may be separately formed and subsequently secured together. Alternatively further, the outer and inner seals of each sealing arrangement may be mounted separately and in non-contact relationship relative to each other.

Further, additional outer and/or inner seals may be provided along the length of the sleeve. Alternatively, a single sealing arrangement may be provided which extends along the full axial length of at least one of the outer and inner surfaces of the sleeve.

Additionally, in the embodiments described above the sleeve is adapted to be slidably mounted on a body. However, the sleeve may alternatively be threadably mounted on a body. Furthermore, the sleeve may function as a connector to connect together two separate bodies. For example, an inner surface of the sleeve of the sealing assembly may incorporate appropriate threads which are adapted to engage corresponding threads on the bodies to be connected together.

The invention claimed is:

1. A downhole sealing assembly comprising a single sleeve adapted to be mounted on a tubular body disposable within a bore, the sleeve including a swellable sealing arrangement comprising a swellable material and inner and outer seals whereby swelling of the swellable material radially inwardly extends the inner seal to establish a seal between the sleeve and the tubular body and radially outwardly extends the outer seal, to establish a seal between the sleeve and a wall of the bore, wherein the inner seal extends along a partial axial length of the sleeve, wherein the sealing arrangement extends over an axial end face of the sleeve between inner and outer surfaces thereof.

2. The assembly of claim 1, wherein the assembly is adapted to function as a packer.

3. The assembly of claim 1, wherein the assembly is adapted to be retrofitted to an existing tubular body.

4. The assembly of claim 1, wherein the sleeve is adapted to be slidably mounted on the tubular body.

5. The assembly of claim 1, comprising fixings for fixing the sleeve to the tubular body.

6. The assembly of claim 1, comprising at least one stop for mounting on the tubular body and limiting axial movement of the sleeve on the tubular body.

7. The assembly of claim 1, wherein the sleeve defines a connector adapted to connect at least two bodies together.

8. The assembly of claim 1, wherein the swellable material is adapted to swell at least in part by volumetric expansion thereof.

9. The assembly of claim 1, wherein the swellable material is adapted to swell upon exposure to an activator.

10. The assembly of claim 1, wherein the outer and inner seals comprise the same swellable material.

11. The assembly of claim 1, wherein the outer and inner seals comprise different swellable materials.

12. The assembly of claim 1, wherein the sleeve comprises a structural element and an outer surface of the sleeve structural element defines a recess adapted to receive and accommodate at least a portion of the outer seal.

13. The assembly of claim 1, wherein the sleeve comprises a structural element and an inner surface of the sleeve structural element defines a recess adapted to receive and accommodate at least a portion of the inner seal.

14. The assembly of claim 1, wherein the inner seal comprises a smaller depth of swellable material than the outer seal.

15. The assembly of claim 1, wherein the outer and inner seals are separately formed.

16. The assembly of claim 1, wherein the outer and inner seals are integrally formed.

17. The assembly of claim 1, wherein the sealing arrangement is moulded onto the sleeve.

18. The assembly of claim 1, wherein the sealing arrangement extends over opposed axial end faces of the sleeve between inner and outer surfaces thereof.

19. The assembly of claim 1, comprising a plurality of sealing arrangements.

20. The assembly of claim 19, wherein a sealing arrangement is mounted on each end region of the sleeve.

21. The assembly of claim 19, wherein the swellable material within each sealing arrangement is the same.

22. The assembly of claim 19, wherein the sealing arrangements comprise different sealing materials.

23. The assembly of claim 22, wherein the swellable material in one sealing arrangement is adapted to swell when exposed to water, and the swellable material in another sealing arrangement is adapted to be activated when exposed to hydrocarbons.

24. The assembly of claim 1, wherein the swelling material comprises a swelling elastomer and the thickness of elastomer provided is selected to provide a predetermined degree of unused swell.

25. The assembly of claim 24, wherein the degree of unused swell of the inner and outer seals is selected to provide a substantially balanced pressure force on the sleeve.

26. The assembly of claim 1, wherein the inner seal defines a terminating end which is positioned intermediate opposite axial ends of the sleeve.

27. The assembly of claim 1, comprising:

a first sealing arrangement mounted on a first axial end region of the sleeve, wherein the first sealing arrangement includes an outer seal and an inner seal;

a second sealing arrangement mounted on a second axial end region of the sleeve, wherein the second sealing arrangement includes an outer seal and an inner seal, wherein the inner seals of the first and second sealing arrangements are axially separated from each other.

28. The assembly of claim 27, wherein an inner surface of the sleeve located between the inner seals of the first and second sealing arrangements is free from any sealing material.

29. The assembly of claim 1, wherein the sleeve is made of metal.

30. A downhole sealing assembly comprising a single sleeve adapted to be mounted on a tubular body disposable within a bore, the sleeve including a swellable sealing arrangement comprising a swellable material and inner and outer seals, whereby swelling of the swellable material radially inwardly extends the inner seal to establish a seal between the sleeve and the tubular body and radially outwardly extends the outer seal, to establish a seal between the sleeve and a wall of the bore, wherein the inner seal extends along a partial axial length of the sleeve, and further comprising a centraliser.

31. The assembly of claim 30, wherein the centraliser is mounted on the sleeve between two sealing assemblies.

32. The assembly of claim 30, wherein the centraliser comprises a material selected to reduce friction between the assembly and an adjacent bore wall.

33. The assembly of claim 30, wherein the centraliser is color-coded to reflect a feature of the assembly.

34. The assembly of claim 33, wherein the centraliser is colour-coded to reflect the triggering fluid for the swellable material.

* * * * *